United States Patent [19]

Roach, Jr.

[11] 4,456,906

[45] Jun. 26, 1984

[54] AUTOMATIC TESTING OF CARRIER RELAY EQUIPMENT IN ELECTRICAL POWER TRANSMISSION LINES

[75] Inventor: Alva B. Roach, Jr., Houston, Tex.

[73] Assignee: Houston Industries, Houston, Tex.

[21] Appl. No.: 302,564

[22] Filed: Sep. 15, 1981

[51] Int. Cl.[3] ..... G08B 29/00

[52] U.S. Cl. ..... 340/516; 340/527; 340/505; 371/22; 178/69 G; 179/175.3 R

[58] Field of Search ..... 340/652, 516, 514, 515, 340/527, 825.13, 825.16, 825.17, 502, 504, 505; 370/13; 179/175.2 D, 175.3 R, 175.31 R; 371/62, 63, 33, 22; 375/10; 178/4.1 B, 70 S, 69 G

[56] References Cited

U.S. PATENT DOCUMENTS

| | | | |
|---|---|---|---|
| 477,712 | 6/1892 | Stromberg | 340/516 |
| 1,394,642 | 10/1921 | Quass | 340/527 |
| 3,133,275 | 5/1964 | Cohrt et al. | 340/652 |
| 3,955,183 | 5/1976 | McBrian | 340/514 |
| 3,970,940 | 7/1976 | Venn | 340/514 X |
| 3,991,362 | 11/1976 | Blair et al. | 340/514 X |
| 4,032,909 | 6/1977 | Boyce | 340/514 |
| 4,044,351 | 8/1977 | Everson | 340/514 X |

OTHER PUBLICATIONS

Wayne Electronic Products Company, Oklahoma City, Oklahoma, WEPCO Test Equipment T-200 Manual, 1968.

Magcon Engineering Company, St. Paul, Minnesota, Carrier Check Slave CS-30 Instruction Manual, approx. 1972.

*Primary Examiner*—John W. Caldwell, Sr.
*Assistant Examiner*—Daniel Myer
*Attorney, Agent, or Firm*—Pravel, Gambrell, Hewitt, Kirk & Kimball

[57] ABSTRACT

In an electrical power transmission system, transmitter-receiver pairs at stations which communicate with similar pairs at other stations to block tripping of circuit breakers or for other control functions are periodically tested. An electrical circuit periodically activates a transmitter to send a test signal from a first station over a power line to a receiver at another station in the system. The receiver at the other station activates the associated transmitter in response to receipt of the incoming signal to send a signal back to the receiver of the first station. If this cycle is not completed in a specified time, indicating loss of communication between the two transmitter-receiver pairs, an alarm is activated.

10 Claims, 3 Drawing Figures

AUTOMATIC TESTING OF CARRIER RELAY EQUIPMENT IN ELECTRICAL POWER TRANSMISSION LINES

BACKGROUND OF THE INVENTION

1. Field of Invention

The present invention relates to testing communication between transmitter-receiver pairs over electrical power transmission lines.

2. Description of Prior Art

In electrical power transmission and distribution systems, carrier relay equipment in the form of transmitter-receiver pairs has been provided at various stations or substations to communicate information, such as whether or not circuit breakers at a particular station are to be tripped when a fault or ground is detected in the system. The operability of these transmitter-receiver pairs and the integrity of their connection over the power transmission lines had to be periodically tested.

One method of testing was to send test technicians to both stations who would operate the carry relay equipment, sending signals between the two stations and verifying receipt of signals from the other station. This clearly was expensive in terms of labor costs.

Two apparatus were proposed in an attempt to solve this problem. Both sent a test signal from a transmitter at a first or master station over the power line to a receiver at a second or slave station for a time interval. At the slave station, a transmitter was activated after receiving the transmitted master station signal, sending a return signal back to the master station. Unless the master station received the return signal in a particular time interval, an alarm was activated. One apparatus used a rotary mechanical drum with rubber cogs which engaged switches to control timing functions. In service usage, dust and other contamination often caused the switches to stick, requiring periodic cleaning of the equipment. Also, the rubber cogs deteriorated with time, becoming brittle and breaking and requiring replacement. The second apparatus used complicated electronics with digital logic circuitry which typically did not stand up to the transient conditions and voltage levels present in power distribution.

U.S. Pat. Nos. 4,044,351 and 3,970,940 tested transmitter-receiver communication over telephone lines and radio waves, respectively. Each was based on detection of time coincidence between the transmitted and received signals. U.S. Pat. No. 4,032,909 tested an alarm system by a test operator tripping a remote sensor and monitoring the response of an alarm with an audio transmitter at a central station. The monitored response was sent by radio waves to a receiver with the test operator to indicate the sensor was in communication with the central station. U.S. Pat. No. 3,991,362 related to a system for preventing tampering with a remote alarm, while U.S. Pat. No. 3,955,183 related to an operability indicator for testing an alarm without causing a false alarm.

SUMMARY OF INVENTION

Briefly, the present invention provides a new and improved apparatus for periodically testing carrier relay equipment in an electrical power transmission and distribusion system. An electrical timer at a first station in the system periodically starts a test cycle at predetermined time intervals. A start relay responds to the timer and forms a shortened starting pulse at the start of the test cycle. A first time delay relay on receipt of operating power causes a transmitter of the carrier relay equipment of the first station to send a carrier signal over a line of the power system to a second station for a predetermined time. A second time delay relay at the first station sets a reply time interval during which a reply signal should be received from the second station if the carrier relay equipment is operating properly and there is no fault in the power lines between the two stations. A detector is provided at the first station for detecting a reply signal from the second station. An alarm indicates no receipt of a reply signal by the detector from the second station within the reply time interval of the second time delay relay. The alarm is disabled in the event of receipt of the reply signal from the second station within the reply time interval. At the second station, a receiver relay detects receipt of the carrier signal sent from the first station, activating a transmitter of the carrier relay equipment of the second station to send a reply signal to the first station. The receiver relay is preferably a time delay relay so that the transmitted test signal and the reply signal are not coincident in time. If complete automation of the testing cycle is not desired, a sequencing relay of the carrier relay test equipment at the second station may function as the receiver relay to activate transmission of the reply signal.

DESCRIPTION OF PREFERRED EMBODIMENT

Figure 1:
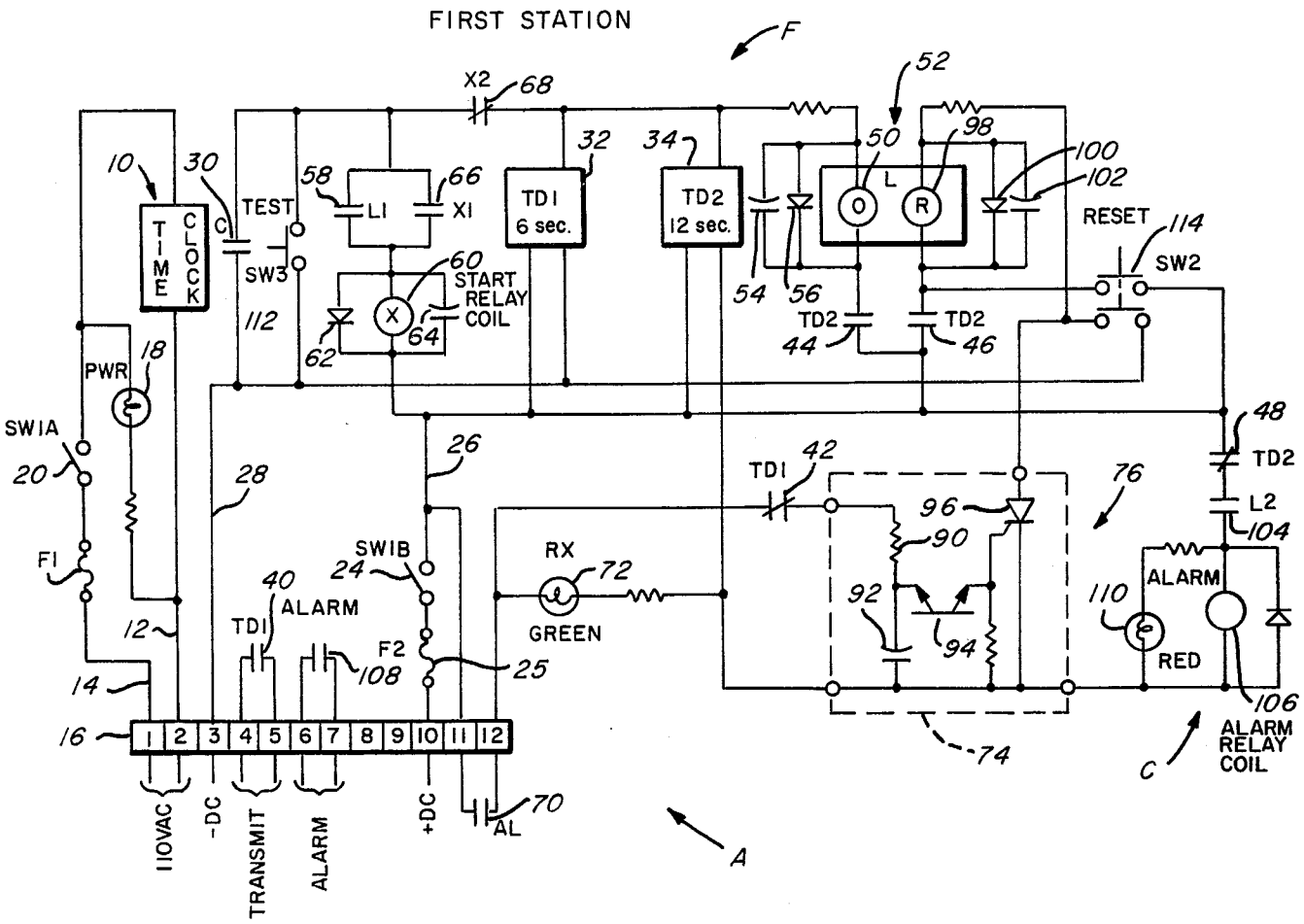
FIG. 1 is a schematic electrical circuit diagram of an apparatus at a power station or substation according to the present invention.

In the drawings, the letter A designates generally an apparatus according to the present invention for periodically testing carrier relay equipment in an electrical power transmission and distribution system. The carrier relay equipment may be of any suitable conventional type, such as that sold by Westinghouse Corporation as KD-4 carrier relay equipment. The carrier relay equipment is in the form of transmitter-receiver pairs which are provided at various stations or substations in electrical power transmission and distribution systems to communicate information such as whether or not circuit breakers at particular stations are to be tripped when a fault or ground is detected in the power transmission or distribution system. Since the carrier relay equipment is conventional, only those portions that are necessary to underestand the interconnections with apparatus A of the present invention are shown in the drawings.

In the apparatus A, an electrical timer 10 at a first or master station F (FIG. 1) in the power distribution or transmission system periodically starts a test cycle at predetermined time intervals, such as once every eight hours. The timer 10 is preferably in the form of a clock timer and receives operating electrical power through conductors 12 and 14 from a connector bus 16. An indicator lamp 18 is connected between the conductor 12 and 14 to indicate that the clock timer 10 is receiving operating electrical power. A contact 20 of a master on-off control switch is provided to control activation of the clock timer 10, permitting flow of electrical current through the timer 10 and a protective fuse 22 when closed.

A contact 24 also under control of the master on-off control switch opens and closes concurrently with contact 20 and electrically connects via a protective fuse 25 the remaining portions of the apparatus A between power supply conductors 26 and 28. Conductors 26 and 28 are electrically connected to the connector bus 16 to provide operating electrical power for the remaining portion of the apparatus A.

Figure 3:
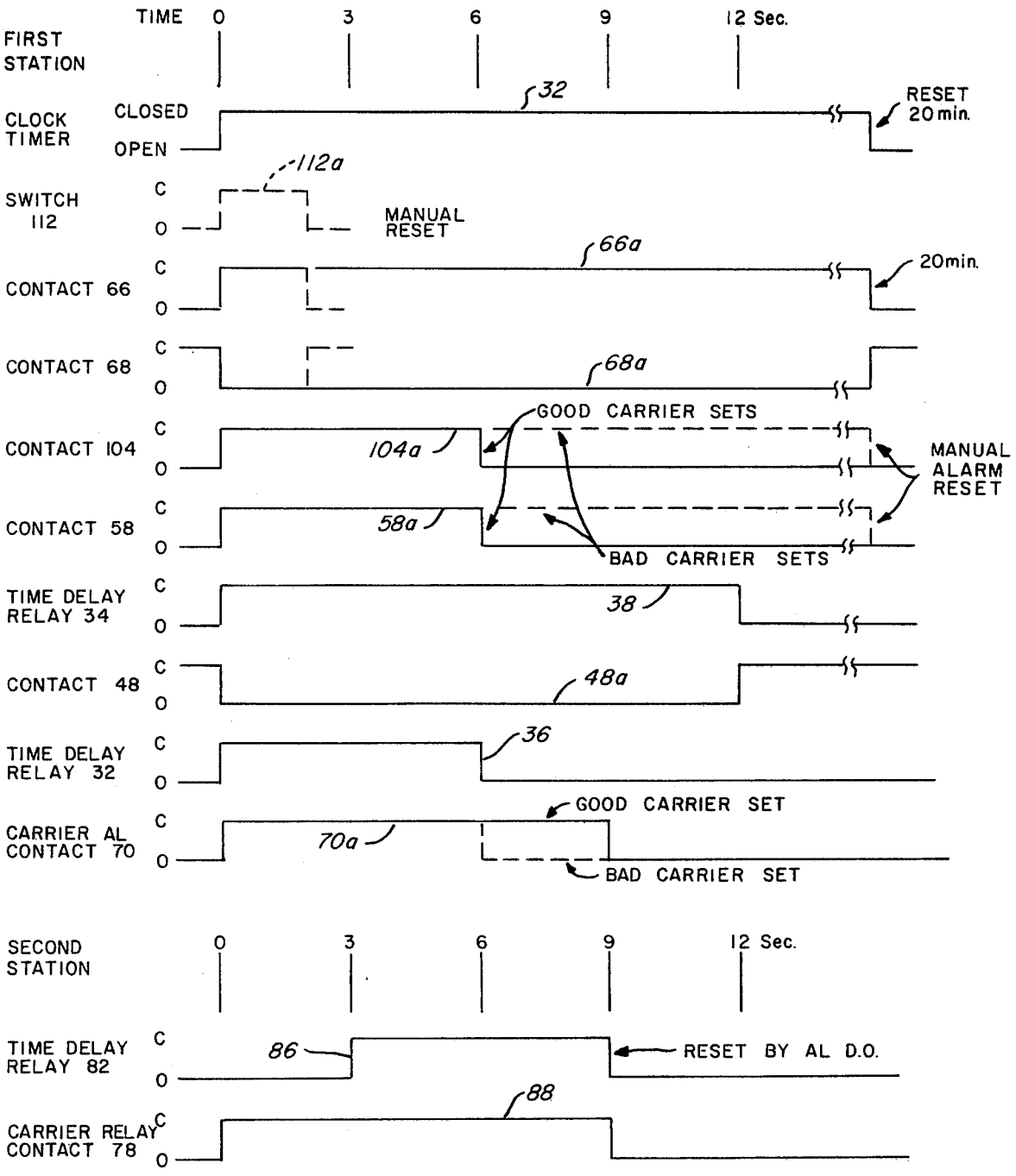
FIG. 3 is a diagram of signals present in the apparatus of FIGS. 1 and 2.

A contact 30 is operable by the clock timer 10 to close at the predetermined time interval. The contact 30 remains closed for a set number of minutes as indicated by a waveform 32 (FIG. 3). A first time delay relay 32 and a (second time relay 34 receive operating electrical power when the contact 30 of clock timer 10 closes. Each of time delay relays 32 and 34 permits electrical current to flow therethrough for predetermined times and then ceases to conduct. The time delay relay 32 conducts for a predetermined interval such as six seconds, as indicated by a waveform 36 (FIG. 3), while the time delay relay 34 conducts for a longer predetermined time interval, such as twelve seconds, as indicated by waveform 38.

Figure 2:
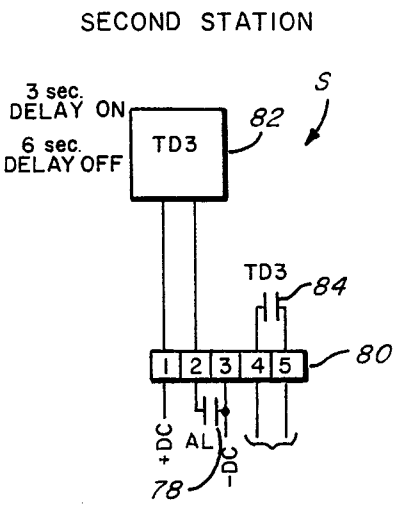
FIG. 2 is a schematic electrical circuit diagram of a receiver relay according to the present invention.

Time delay relay 32, when conducting, closes a contact 40, permitting electrical current to flow therethrough to cause a transmitter of the carrier relay equipment at the first station to send a carrier signal over a line of the electrical power distribution or transmission system to a second or slave station S (FIG. 2) for the time interval that time delay relay 32 conducts. Time delay relay 32 when conducting also opens a contact 42 to prevent erroneous detection of the transmitted carrier signal from the transmitter from being detected as a reply signal from the station S.

Time delay relay 34, when conducting, closes contacts 44 and 46 and opens a contact 48. Closure of contact 44 permits operating electrical current to flow through a first or operate coil 50 of a latch relay 52. The coil 50 has a protective capacitor 54 and diode 56 electrically connected in parallel to protect such coil from electrical transients. When the coil 50 receives electrical current, a contact 58 associated therewith closes and allows electrical current to flow through a start relay 60 which forms a short duration starting pulse and also prevents the closed contact 30 from passing current during the remainder of the test cycle begun by the clock timer 10. A waveform 58*a* illustrates signal levels present at contact 58 during its operation. The effect of operation of start relay 60 is to form a pulse of much shorter duration (such as a fraction of a second) than the interval of clock timer 10 to trigger relays 32 and 34 into operation and to energize the operable coil 50 of relay 52. A diode 62 and capacitor 64 are electrically connected in parallel with the coil 60 for protection against transients. Start relay coil 60 closes a contact 66 to latch itself in and opens a contact 68 to block current from closed contact 30 on receipt of electrical current. Voltage waveforms 66*a* and 68*a* (FIG. 3) indicate signals present at contacts 66 and 68, respectively during the operation of test relay 60.

During the time that the carrier relay equipment is transmitting due to the closure of contact 40 of the first time delay relay 32, an AL contact 70 of the carrier relay equipment electrically connected to the connector bus 16 is closed, activating an indicator light 72 to indicate such transmission is occurring. The AL contact 70 is also closed when the carrier relay equipment at the first station F is receiving signals from the second station S. A waveform 70*a* indicates signal levels present at contact 70 during its operation. However, as set forth above, contact 42 of the first time delay relay 32 is open, preventing the flow of electrical current into a time delay circuit 74 of a detector circuit 76. The function of detector circuit 76 is to detect a reply signal sent by carrier relay equipment from the second station S (FIG. 2) in response to the transmission of the signal from the first station F (FIG. 1) within a reply time interval established by the second time delay relay 34.

At the second station S, on receipt of the signal sent from the first station, an AL contact 78 of the carrier relay equipment at the second station closes on receipt of the signal from the first station, permitting electrical current to flow from a connector bus 80 through a receiver relay 82. The receiver relay 82 detects receipt of carrier signals sent from the first station S and activates a transmitter of the carrier relay equipment of the second station S to send a reply signal to the first station F. Receiver relay 82 is preferably a time delay relay having a predetermined time delay, such as three seconds, before a contact 84 associated therewith closes, causing a waveform 86 (FIG. 3).

On closure of the contact 84, the transmitter of the carrier relay equipment at the second station S is activated. Time delay relay 82 remains conductive after the initial time delay for a predetermined time interval and then opens the contact 84, inhibiting further transmission of the reply signal by the carrier relay equipment from the second station S over the power lines to the first station F. During the time that the carrier relay equipment is either transmitting or receiving, the AL contact 78 is closed, forming a waveform 88.

In the preferred embodiment, the time delay relay 82 is provided according to the present invention at the second station S. It should be understood, however, that when complete automation of testing cycle according to the present invention is not necessary or desired, a conventional sequencing relay in the carrier relay equipment at the second station S may function as the receiver relay to activate transmission of the reply signal in place of the time delay relay 82.

After the time interval set by the first time delay relay 32 for transmission of a signal to the second station S elapses, contact 42 associated with the relay 32 closes, connecting the time delay circuit 74 to the AL contact 70 of the carrier relay equipment at the station F. When a reply signal is received at the station F from the second station S, the contact 70 closes, permitting electrical current to flow through a resistor 90 of the time delay circuit 74 and charge capacitor 92. The impedance values of resistor 90 and capacitor 92 are chosen to establish a suitable time delay to prevent transients or impulses from improperly triggering detector circuit 76. A diac or electronic switch 94 is rendered conductive when the charge in the capacitor 92 reaches a predetermined level, causing an electronic switch preferably in the form of a silicon controlled rectifier 96 to become conductive. Switch 96 when conductive permits electrical current to flow through a second coil 98 of the latch relay 52 provided that contact 46 of the second time delay relay 34 is closed. As with the coil 50, coil 98 of the latch relay 52 is provided with a parallel connected protective diode 100 and capacitor 102. Coil 98, when conducting, opens contact 104 associated therewith and disables the alarm circuit C, preventing the flow of electrical current therethrough. Waveform 104*a* illustrates voltage levels present at contact 104. As indicated, contact 104 is initially closed when coil 50 of latch relay 52 receives electrical current.

In the alarm circuit C, a relay coil 106 on receipt of electrical current closes an alarm contact 108 electrically connected to connector bus 16 to indicate that a reply signal has not been received from the second station S within the reply time interval of the second time delay relay 34. Contact 108 when closed activates through connector bus 16 a suitable type of alarm such as visual or audible alarm, as well as permitting an appropriate signal to be sent to supervisory control equipment, if desired. Indicator lamp 110 is electrically connected with the coil 106 to indicate that no such reply signal has been received.

The circuitry of the apparatus A at the first station F also includes a manual test switch 112 which permits an operator to manually test the carrier relay equipment at the first station F and the second station S and the power lines therebetween independently of and at times other than those set by the timer 10. Waveform 112*a* illustrates voltage levels present when switch 112 is operated. A manual reset button 114 is also provided to reset the apparatus A when desired. The effect of reset button 114 on switch 112, on contacts 66 and 68 of test relay 60 and on contacts 58 and 104 of latch relay 52 is indicated in the waveforms of FIG. 3, terminating a test cycle if desired, and also resetting alarm circuit C when necessary.

In the operation of the present invention, a test cycle is begun by the clock timer 10 or, alternatively, by depression of the switch 112 by an operator. The first time delay relay 32 causes the transmitter of the carrier relay equipment at the first station F to send a test signal for the duration of waveform 36 over the power lines by means of which power is transmitted between the stations F and S. At the second station S, if the signal is detected, time delay relay 82 closes contact 84, causing a reply signal to be sent to the first station F for the duration of waveform 86. At the first station F, at the end of the reply time interval set by the second time delay relay 34 indicated by waveform 38, contact 48 of relay 34 closes and permits electrical current to flow to the alarm circuit C unless detector circuit 76 has detected the reply signal from the second station S and permitted current to flow through coil 98 of latch relay 52 to open contact 104 and disable the alarm circuit C.

From the foregoing, it can be seen that the apparatus A of the present invention periodically tests carrier relay equipment in the electrical power transmission and distribution systems in an effective and reliable manner. It should be understood that the time intervals set forth for the test cycle above are only by way of example and that shorter or longer time intervals may be used. For shorter time intervals, time settings become more important. However, the time intervals set forth above have been found to be adequate, providing a reasonable constraint on the accuracy of time interval settings. In the preferred embodiment, the time delay relays 32, 34 and 82 are preferably of the adjustable direct current static type, although other types of time delay relays could equally as well be used, such as pneumatic or thermal time delay relays.

With the apparatus A of the present invention, and with the circuitry thereof at the second station S, carrier relay testing operations no longer require two operators at opposite ends of the transmission line in question be present to perform carrier relay testing. Rather, the equipment automatically completes the entire testing cycle with no operators involved and signals an alarm if the equipment testing is unsuccessful. The alarm in the form of a bell or light can be viewed or heard on location and can also be sent by remote control equipment to a central location. This is particularly useful in situations where the second station S is remotely located and relatively inaccessible sible or when the station S is owned by a customer of the electrical power company and is for this reason not readily accessible.

The foregoing disclosure and description of the inven-tion are illustrative and explanatory thereof, and various changes in the size, shape, materials, components, circuit elements, wiring connections and contacts, as well as in the details of the illustrated circuitry and construction may be made without departing from the spirit of the invention.

I claim:

1. An apparatus for periodically testing carrier relay equipment in an electrical power transmission and distribution system comprising:

(a) electrical timer means at a first station in the system for periodically starting a test cycle at predetermined times;

(b) a start relay at the first station responsive to said electrical timer means for forming a starting pulse;

(c) a first time delay relay at the first station for causing a transmitter of the carrier relay equipment of the first station to send a carrier signal over a line of the system to a second station for a predetermined time;

(d) a second time delay relay at the first station for setting a reply time interval within which a reply signal should be received from the second station;

(e) means for detecting a reply signal from the second station;

(f) alarm means for indicating no receipt of a reply signal from the second station within the reply time interval of said second time delay relay; and (g) means for disabling said alarm means in the event of receipt of the reply signal from the second station within the reply time interval.

2. The apparatus of claim 1, further including:

receiver relay means at the second station for detecting receipt of the carrier signal sent from the first station, said receiver relay activating a transmitter of the carrier relay equipment of the second station to send a reply signal to the first station.

3. The apparatus of claim 2, wherein said receiver relay means comprises:

a time delay relay having a predetermined time delay in response to receipt of the carrier signal before activating the transmitter of the carrier relay equipment of the second station.

4. The apparatus of claim 1, further including:

reset switch means for resetting the test cycle.

5. The apparatus of claim 1, further including:

means for preventing the operation of said means for detecting during operation of the transmitter of the carrier relay equipment of the first station.

6. The apparatus of claim 1, wherein said means for detecting comprises:

(a) a latch relay; and (b) electronic switch means for permitting electrical current to flow in said latch relay in response to detection of a reply signal.

7. The apparatus of claim 6, wherein said means for detecting further includes:

a time delay circuit for enabling said electronic switch means in response to detection of a reply signal for a predetermined time.

8. The apparatus of claim 6, wherein said latch relay has at least one coil and further including:

a diode and capacitor electrically connected in parallel with said coil of said latch relay for protecting said coil against electrical transients.

9. The apparatus of claim 1, further including:

switch means for starting a test cycle independently of said electrical timer means.

10. The apparatus of claim 1, further including: reset switch means for resetting said alarm means.

* * * * *

UNITED STATES PATENT AND TRADEMARK OFFICE

CERTIFICATE OF CORRECTION

PATENT NO. : 4,456,906

DATED : 26 June 1984

INVENTOR(S) : Alva B. Roach, Jr.

It is certified that error appears in the above-identified patent and that said Letters Patent is hereby corrected as shown below:

In Column 1, Line 66: please delete "distribusion" and insert therefor --distribution--.

In Column 2, Line 56: please delete "underestand" and insert therefor --understand--.

In Column 3, Line 16: please delete "(second" and insert therefor --second--.

In Column 3, Line 61: please delete "respectively" and insert therefor --respectively,--.

In Column 6, Line 9: please delete "inaccessible sible" and insert therefor --inaccessible--.

In Column 6, Line 13: please delete "ven-tion" and insert therefor --vention--.

Signed and Sealed this

*Twenty-third* Day of *October 1984*

[SEAL]

*Attest:*

GERALD J. MOSSINGHOFF

*Attesting Officer*

*Commissioner of Patents and Trademarks*